US012649987B2

(12) United States Patent
Dunn et al.

(10) Patent No.: US 12,649,987 B2
(45) Date of Patent: Jun. 9, 2026

(54) LAUNDRY TREATMENT APPLIANCE INCLUDING A VARIABLE SPEED BLOWER FAN AND METHOD OF OPERATING THE SAME

(71) Applicant: Haier US Appliance Solutions, Inc., Wilmington, DE (US)

(72) Inventors: David Scott Dunn, Louisville, KY (US); Ionelia Silvia Prajescu, Louisville, KY (US); Jivko Ognianov Djerekarov, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 596 days.

(21) Appl. No.: 18/169,758

(22) Filed: Feb. 15, 2023

(65) Prior Publication Data

US 2024/0271355 A1 Aug. 15, 2024

(51) Int. Cl.

| | |
|---|---|
| ***D06F 58/38*** | (2020.01) |
| ***D06F 58/26*** | (2006.01) |
| *D06F 103/32* | (2020.01) |
| *D06F 103/34* | (2020.01) |
| *D06F 105/30* | (2020.01) |

(52) U.S. Cl.

CPC ..... *D06F 58/38* (2020.02); *D06F 58/26* (2013.01); *D06F 2103/32* (2020.02); *D06F 2103/34* (2020.02); *D06F 2105/30* (2020.02)

(58) Field of Classification Search

CPC ..... D06F 58/38; D06F 58/26; D06F 2103/32; D06F 2103/34; D06F 2105/30; D06F 58/206

USPC ..... 34/282

See application file for complete search history.

(56) References Cited

U.S. PATENT DOCUMENTS

| | | | | |
|---|---|---|---|---|
| 8,919,009 | B2 | 12/2014 | Colombo et al. | |
| 9,534,340 | B2 | 1/2017 | Cavarretta et al. | |
| 11,060,236 | B2 | 7/2021 | Djerekarov et al. | |
| 2013/0019495 | A1* | 1/2013 | Colombo | D06F 58/48 34/565 |
| 2021/0102333 | A1* | 4/2021 | Djerekarov | D06F 58/30 |
| 2021/0115619 | A1* | 4/2021 | Dunn | D06F 58/206 |
| 2021/0156073 | A1* | 5/2021 | Kim | D06F 58/04 |
| 2024/0011681 | A1* | 1/2024 | Fujii | B23K 26/703 |

FOREIGN PATENT DOCUMENTS

| | | | |
|---|---|---|---|
| WO | WO2013167488 | A2 | 11/2013 |
| WO | WO2015082018 | A1 | 6/2015 |

* cited by examiner

*Primary Examiner* — John P McCormack
(74) *Attorney, Agent, or Firm* — Dority & Manning, P.A.

(57) ABSTRACT

A laundry treatment appliance includes a cabinet; a drum rotatably mounted within the cabinet; a sealed system; a duct system; a blower fan capable of operating at variable rotational speeds; and a controller configured to perform an operation. The operation includes directing the blower fan at a preliminary rotational speed; determining a condensation capacity of the sealed system with regards to the process air in the duct system; determining a mass flow rate of moisture in the process air while directing the blower fan at the preliminary rotational speed; determining a target rotational speed of the blower fan corresponding to a set ratio of the determined condensation capacity to the determined mass flow rate; and directing the blower fan at the determined target rotational speed.

16 Claims, 4 Drawing Sheets

LAUNDRY TREATMENT APPLIANCE INCLUDING A VARIABLE SPEED BLOWER FAN AND METHOD OF OPERATING THE SAME

FIELD OF THE INVENTION

The present subject matter relates generally to laundry appliances, and more particularly to laundry appliances with variable speed blower fans to provide efficient drying.

BACKGROUND OF THE INVENTION

Closed loop airflow circuit laundry appliances can efficiently dry laundry articles. Example closed loop airflow circuit laundry appliances include condenser dryers, heat pump dryers, and spray tower dryer appliances. Such dryer appliances include a closed loop airflow circuit along which process air is moved. The process air is conditioned by a conditioning system, e.g., to remove moisture from the process air after the air has absorbed water from articles and also heats the air to increase the moisture capacity of the air.

For example, a heat pump dryer uses a refrigerant cycle to both provide hot air to the dryer and to condense water vapor in air coming from the dryer. Since the moisture content in the air from the dryer is reduced by condensation over the evaporator, this same air can be reheated again using the condenser and then passed through the dryer again to remove more moisture.

In many dryer appliances (or combination laundry appliances operating a drying cycle), each of the closed loop refrigerant system and a blower fan to circulate air through the drum are operated at a constant speed. Each of the closed loop system and the air flow system have a capacity for circulating and removing moisture from the air. However, current laundry appliances may provide inefficient drying due to an imbalance between a moisture removal rate of the closed loop system and a moisture supply rate from the air flow system.

Accordingly, a laundry treatment appliance that obviates one or more of the above-mentioned drawbacks would be beneficial. In particular, a laundry treatment appliance that improves efficiency of a drying operation would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet; a drum rotatably mounted within the cabinet, the drum defining a chamber for receipt of articles, the drum defining a drum outlet and a drum inlet to the chamber; a sealed system configured to heat and remove moisture from process air flowing therethrough, the sealed system including a compressor operable to urge a refrigerant through a refrigerant line; a duct system for providing fluid communication between the drum outlet and the sealed system and between the sealed system and the drum inlet, the duct system, the sealed system, and the drum defining a process air flow path; a blower fan operable to move process air along the process air flow path, the blower fan capable of operating at variable rotational speeds; and a controller configured to perform an operation. The operation may include directing the blower fan at a preliminary rotational speed; determining a condensation capacity of the sealed system with regards to the process air in the duct system; determining a mass flow rate of moisture in the process air while directing the blower fan at the preliminary rotational speed; determining a target rotational speed of the blower fan corresponding to a set ratio of the determined condensation capacity to the determined mass flow rate; and directing the blower fan at the determined target rotational speed.

In another exemplary aspect of the present disclosure, a method of operating a laundry treatment appliance is provided. The laundry treatment appliance may include a drum, a duct system in fluid communication with the drum through which process air flows, a sealed system including a compressor configured to heat and remove moisture from the process air, and a blower fan provided within the duct system. The method may include directing the blower fan at a preliminary rotational speed, determining a condensation capacity of the sealed system with regards to the process air in the duct system, determining a mass flow rate of moisture in the process air while directing the fan at the preliminary rotational speed, determining a target rotational speed of the blower fan corresponding to a set ratio of the determined condensation capacity to the determined mass flow rate, and directing the blower fan at the determined target rotational speed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
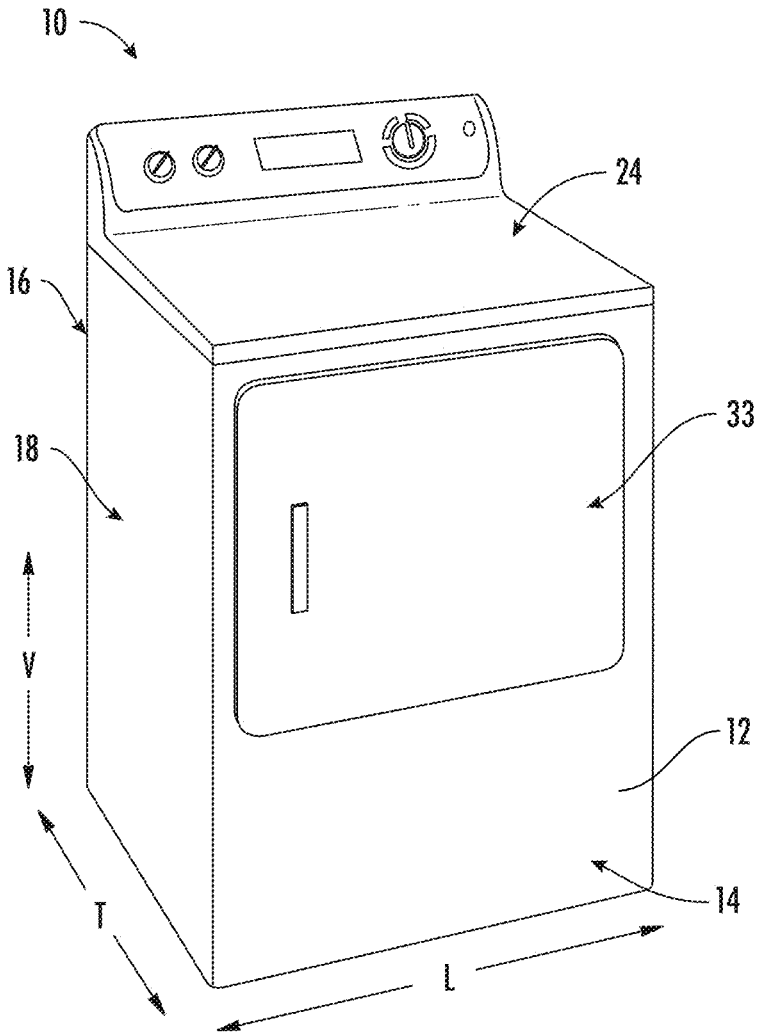
FIG. 1 provides a perspective view of a laundry appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may.

Any implementation described herein as "exemplary" or "an embodiment" is not necessarily to be construed as preferred or advantageous over other implementations.

Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
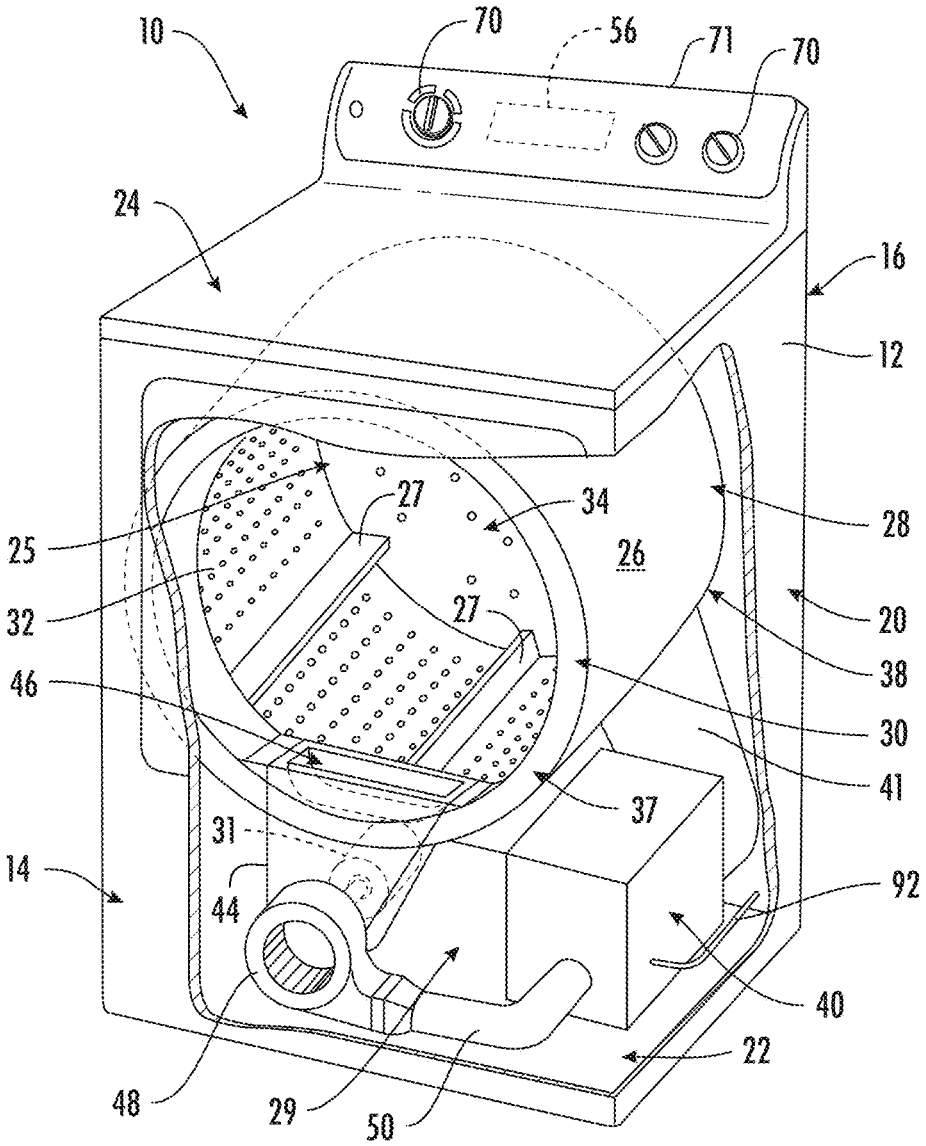
FIG. 2 provides a perspective view of the example laundry appliance of FIG. 1 with portions of a cabinet of the laundry appliance removed to reveal certain components of the laundry appliance.

FIGS. 1 and 2 provide perspective views of a laundry appliance 10 according to exemplary embodiments of the present disclosure. Laundry appliance 10 is a dryer appliance in the illustrated embodiments and may also, in additional embodiments, include features for washing articles (e.g., laundry appliance 10 may also or instead be a combination laundry appliance). In particular, FIG. 1 provides a perspective view of dryer appliance 10 and FIG. 2 provides another perspective view of dryer appliance 10 with a portion of a housing or cabinet 12 of dryer appliance 10 removed in order to show certain components of dryer appliance 10. As depicted, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other laundry appliances having different appearances and different features may also be utilized with the present subject matter as well. For instance, in some embodiments, laundry appliance 10 can be a combination washing machine/dryer appliance.

Cabinet 12 includes a front panel 14, a rear panel 16, a pair of side panels 18 and 20 spaced apart from each other by front and rear panels 14 and 16 along the lateral direction L, a bottom panel 22, and a top cover 24. Cabinet 12 may define an interior volume 29. A drum or container 26 may be mounted for rotation about a substantially horizontal axis within interior volume 29 of cabinet 12. Drum 26 may define a chamber 25 for receipt of articles for tumbling and/or drying. Drum 26 may extend between a front portion 37 and a back portion 38, e.g., along the transverse direction T. Drum 26 may also include a back or rear wall 34, e.g., at back portion 38 of drum 26. A supply duct 41 may be mounted to rear wall 34. Supply duct 41 may receive heated air that has been heated by a conditioning system 40 and provide the heated air to drum 26 via one or more holes defined in rear wall 34. Additionally or alternatively, in some embodiments, a tub (not shown) is included in which drum 26 is nested (e.g., in a combination washing machine/dryer appliance).

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance (e.g., clothes dryer) and may include a mixture of different or similar articles of clothing of different or similar types and kinds of fabrics, textiles, garments and linens within a particular laundering process.

In some embodiments, a motor 31 is provided to rotate drum 26 about the horizontal axis, e.g., via a pulley and a belt (not shown). Drum 26 may be generally cylindrical in shape. Drum 26 may have an outer cylindrical wall 28 and a front flange or wall 30 that defines an opening 32 of drum 26, e.g., at front portion 37 of drum 26, for loading and unloading of articles into and out of chamber 25 of drum 26. Drum 26 may include a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear wall 34 of drum 26 is rotatably supported within cabinet 12 by a suitable bearing. Rear wall 34 may be fixed or may be rotatable. Rear wall 34 may include, for instance, a plurality of holes that receive hot air that has been heated by a conditioning system 40, e.g., a heat pump or refrigerant-based conditioning system as will be described further below. Moisture laden, heated air may be drawn from drum 26 by an air handler, such as a blower fan 48, which generates a negative air pressure within drum 26. The moisture laden heated air may pass through a duct 44 enclosing screen filter 46, which traps lint particles. As the air passes from blower fan 48, it enters a duct 50 and then is passed into conditioning system 40. In some embodiments, dryer appliance 10 is a heat pump dryer appliance and thus conditioning system 40 may be or include a heat pump including a sealed refrigerant circuit, as described in more detail below with reference to FIG. 3. Heated air (with a lower moisture content than was received from drum 26), may exit conditioning system 40 and return to drum 26 by duct 41. After the clothing articles have been dried, they may be removed from drum 26 via opening 32. A door 33 may provide for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are communicatively coupled with (e.g., electrically coupled or coupled through a wireless network band) a processing device or controller 56. Controller 56 may also be communicatively coupled with various operational components of dryer appliance 10, such as motor 31, blower 48, and/or components of conditioning system 40. In turn, signals generated in controller 56 may direct operation of motor 31, blower 48, or conditioning system 40 in response user inputs to selector inputs 70. As used herein, "processing device" or "controller" may refer to one or more microprocessors, microcontroller, ASICS, or semiconductor devices and is not restricted necessarily to a single element. Controller 56 may be programmed to operate dryer appliance 10 by executing instructions stored in memory (e.g., non-transitory media). Controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by controller 56.

Figure 3:
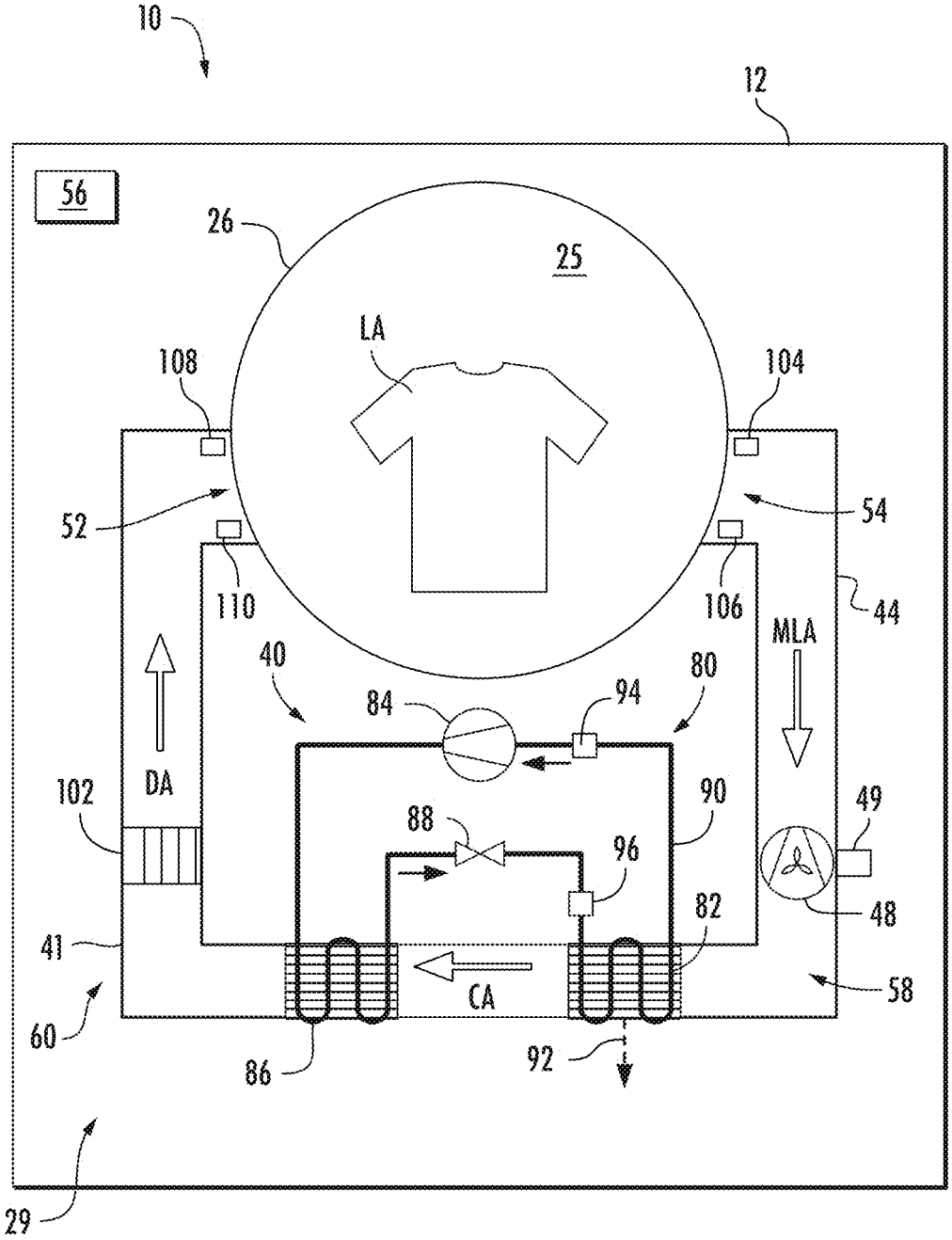
FIG. 3 provides a schematic diagram of an exemplary heat pump laundry appliance and a conditioning system thereof in accordance with exemplary embodiments of the present disclosure.

FIG. 3 provides a schematic view of laundry appliance 10 and depicts conditioning system 40 in more detail. For this embodiment, laundry appliance 10 is a heat pump dryer appliance and thus conditioning system 40 includes a sealed system 80. In additional embodiments, the conditioning system 40 illustrated in FIG. 3 and described herein may also be provided in, for example, a combination washing machine/dryer appliance. Sealed system 80 may include various operational components, which may be encased or located within a machinery compartment of dryer appliance 10. Generally, the operational components are operable to execute a vapor compression cycle for heating process air passing through conditioning system 40. The operational components of sealed system 80 may include an evaporator 82, a compressor 84, a condenser 86, and one or more expansion devices 88 connected in series along a refrigerant circuit or line 90. In the illustrated embodiments, expansion device 88 is an expansion valve, such as an electronic expansion valve. Refrigerant line 90 may be charged with a working fluid, which in this example is a refrigerant. Sealed system 80 depicted in FIG. 3 is provided by way of example only. Thus, it is within the scope of the present subject matter for other configurations of the sealed system to be used as well. For example, in some embodiments, expansion device 88 may also or instead include a capillary tube. As will be understood by those skilled in the art, sealed system 80 may include additional components, e.g., at least one additional evaporator, compressor, expansion device, and/or condenser. As an example, sealed system 80 may include two (2) evaporators.

In some embodiments, sealed system 80 may optionally include one or more sensors for measuring characteristics of the sealed system 80. For example, sealed system 80 may include a suction line temperature sensor 94, e.g., upstream of compressor 84. As another example, sealed system 80 may include an evaporator inlet temperature sensor 96 positioned at an inlet of evaporator 92 and configured to measure a temperature of the refrigerant at the inlet of evaporator 92.

In performing a drying and/or tumbling cycle, one or more laundry articles LA may be placed within chamber 25 of drum 26. Hot dry air DA may be supplied to chamber 25 via duct 41. The hot dry air DA may enter chamber 25 of drum via a drum inlet 52 defined by drum 26, e.g., the plurality of holes defined in rear wall 34 of drum 26 as shown in FIG. 2. The hot dry air DA provided to chamber 25 may cause moisture within laundry articles LA to evaporate. Accordingly, the air within chamber 25 increases in water content and exits chamber 25 as warm moisture laden air MLA. The warm moisture laden air MLA may exit chamber 25 through a drum outlet 54 defined by drum 26 and flow into duct 44.

After exiting chamber 25 of drum 26, the warm moisture laden air MLA may flow downstream to conditioning system 40. Blower fan 48 may move the warm moisture laden air MLA, as well as the air more generally, through a process air flow path 58 defined by drum 26, conditioning system 40, and duct system 60. Thus, generally, blower fan 48 may be operable to move air through or along process air flow path 58. Duct system 60 may include all ducts that provide fluid communication (e.g., airflow communication) between drum outlet 54 and conditioning system 40 and between conditioning system 40 and drum inlet 52. Although blower fan 48 is shown positioned between drum 26 and conditioning system 40 along duct 44, it will be appreciated that blower fan 48 can be positioned in other suitable positions or locations along duct system 60.

In addition, according to an exemplary embodiment, blower fan 48 may be a variable speed fan such that it may rotate at different rotational speeds, thereby generating different air flow rates. In this manner, the amount of MLA drawn from chamber 25 may be continuously and precisely regulated. Moreover, by pulsing the operation of blower fan 48 or throttling blower fan 48 between different rotational speeds, the flow of MLA drawn from chamber 25 may have a different flow velocity or may generate a different flow pattern within duct system 60. Thus, by pulsating the variable speed blower fan 48 or otherwise varying its speed, the flow of MLA may be randomized, thereby adjusting a mass flow rate of moisture through sealed system 40.

As further depicted in FIG. 3, the warm moisture laden air MLA may flow into or across evaporator 82 of the conditioning system 40. As the moisture laden air MLA passes across evaporator 82, the temperature of the air may be reduced through heat exchange with refrigerant that is vaporized within, for example, coils or tubing of evaporator 82. This vaporization process may absorb both the sensible and the latent heat from the moisture laden air MLA—thereby reducing its temperature. As a result, moisture in the air is condensed and such condensate water may be drained from conditioning system 40, e.g., using a drain line 92, which is also depicted in FIG. 2.

Air passing over evaporator 82 may become cooler than when it exited drum 26 at drum outlet 54. As shown in FIG. 3, cool air CA (cool relative to hot dry air DA and moisture laden air MLA) flowing downstream of evaporator 82 may subsequently flow across condenser 86, e.g., across coils or tubing thereof, which condenses refrigerant therein. The refrigerant may enter condenser 86 in a gaseous state at a relatively high temperature compared to the cool air CA from evaporator 82. As a result, heat energy may be transferred to the cool air CA at the condenser 86, thereby elevating its temperature and providing warm dry air DA for resupply to drum 26 of dryer appliance 10. The warm dry air DA passes over and around laundry articles LA within chamber 25 of drum 26, such that warm moisture laden air MLA is generated, as mentioned above. Because the air is recycled through drum 26 and conditioning system 40, dryer appliance 10 may have a much greater efficiency than traditional clothes dryers can where all of the warm, moisture laden air MLA is exhausted to the environment.

In some embodiments, conditioning system 40 of dryer appliance 10 optionally includes an electric heater 102 positioned to provide heat to process air flowing along the process air flow path 58, e.g., as shown in FIG. 3. Electrical heater 102 may receive electrical power (e.g., from a power source) and may generate heat based at least in part on the received electrical power. The generated heat may be imparted to the process air flowing along the process air flow path 58.

With respect to sealed system 80, compressor 84 may pressurize refrigerant (i.e., increase the pressure of the refrigerant) passing therethrough and generally motivate refrigerant through the sealed refrigerant circuit or refrigerant line 90 of conditioning system 40. Compressor 84 may be communicatively coupled with controller 56 (communication lines not shown in FIG. 3). Refrigerant may be supplied from evaporator 82 to compressor 84 in a low pressure gas phase. The pressurization of the refrigerant within compressor 84 may increase the temperature of the refrigerant. The compressed refrigerant may be fed from compressor 84 to condenser 86 through refrigerant line 90. As the relatively cool air CA from evaporator 82 flows across condenser 86, the refrigerant may be cooled and its temperature is lowered as heat is transferred to the air for supply to chamber 25 of drum 26.

Upon exiting condenser 86, the refrigerant may be fed through refrigerant line 90 to expansion valve 88. Expansion valve 88 may lower the pressure of the refrigerant and control the amount of refrigerant that is allowed to enter the evaporator 82. The flow of liquid refrigerant into evaporator 82 may be limited by expansion valve 88 in order to keep the pressure low and allow expansion of the refrigerant back into the gas phase in evaporator 82. The evaporation of the refrigerant in evaporator 82 may convert the refrigerant from its liquid-dominated phase to a gas phase while cooling and drying the moisture laden air MLA received from chamber 25 of drum 26. The process is repeated as air is circulated along process air flow path 58 while the refrigerant is cycled through sealed system 80, as described above.

Although dryer appliance 10 is depicted and described herein as a heat pump dryer appliance, in at least some embodiments, dryer appliance 10 may be a combination washer/dryer appliance.

Dryness of the laundry articles LA may be detected based on one or more parameters of the sealed system 80. For example, such parameters may include temperature, pressure, and/or superheat. Over the course of the drying cycle or operation, as the moisture content in the laundry articles LA decreases, i.e., when the laundry articles LA are dry or nearly dry, the capacity of the moisture laden air MLA to transfer heat to the refrigerant in the evaporator decreases. More particularly, as the remaining moisture content in the laundry articles LA decreases, the humidity and latent heat of the moisture laden air MLA decreases. Thus, when there is less latent heat in the MLA for the vaporization process to absorb, the refrigerant may transition from liquid phase to vapor phase more slowly and/or incompletely. For example, this may result in a reduction in the degree of superheat in the refrigerant system, whereby the refrigerant remains in a liquid phase for a longer time. For example, liquid refrigerant may be present at the end of evaporator coil 82 when the moisture laden air MLA is relatively (e.g., as compared to earlier in the dry cycle) less humid. Those of ordinary skill in the art will recognize that the degree of superheat refers to the extent to which the vaporized refrigerant exceeds the boiling point of the refrigerant. Thus, when the refrigerant in the evaporator absorbs less heat from the moisture laden air MLA, e.g., when there is less latent heat in the moisture laden air MLA because there is less moisture in the laundry articles LA, the degree of superheat in sealed system 80, and in particular at or around evaporator 82, such as at the evaporator inlet and/or in the suction line between evaporator 82 and compressor 84, will be less than the degree of superheat in sealed system 80 when the moisture laden air MLA is relatively high (e.g., earlier in the dry cycle, when the remaining moisture content of the laundry articles is high).

The degree of superheat mentioned above may be referred to as a condensation capacity of, for instance, sealed system 80. For instance, the condensation capacity of sealed system 80 may refer to an amount of moisture that sealed system 80 (e.g., evaporator 82) is able to remove from moisture laden air MLA. In detail, the condensation capacity of sealed system 80 may depend on a speed of compressor 84, a temperature of the refrigerant at suction line temperature sensor 94, and a temperature of the refrigerant at inlet line temperature sensor 96. Accordingly, in some embodiments, the condensation capacity of sealed system 80 is limited by a maximum speed of compressor 84.

The moisture laden air MLA, the cold air CA, and the dry air DA may collectively be referred to as the process air flowing through duct system 60. For instance, as described above, the MLA may exit chamber 25 via drum outlet 54. Laundry appliance 10 may include a temperature sensor (e.g., process air temperature sensor) 104 within duct system 60. Temperature sensor 104 may be provided at or near drum outlet 54. For instance, temperature sensor 104 may be located within duct system 60 immediately adjacent drum outlet 54 (i.e., such that air exiting drum 26 flows over temperature sensor 104). Temperature sensor 104 may be configured to sense a temperature of MLA immediately upon exiting chamber 25. Temperature sensor 104 may be operably connected with controller 56. Accordingly, the sensed temperature of the MLA may be transmitted to controller 56.

As used herein, "temperature sensor" or the equivalent is intended to refer to any suitable type of temperature measuring system or device positioned at any suitable location for measuring the desired temperature. Thus, for example, temperature sensor 104 may each be any suitable type of temperature sensor, such as a thermistor, a thermocouple, a resistance temperature detector, a semiconductor-based integrated circuit temperature sensors, etc. In addition, temperature sensor 104 may be positioned at any suitable location and may output a signal, such as a voltage, to a controller that is proportional to or indicative of the temperature being measured. Although exemplary positioning of temperature sensors is described herein, it should be appreciated that laundry appliance 10 may include any other suitable number, type, and position of temperature, humidity, or other sensors according to alternative embodiments.

Laundry appliance 10 may include a humidity sensor (or relative humidity sensor) 106. Humidity sensor 106 may be provided at or near drum outlet 54 (e.g., within duct system 60). For instance, humidity sensor 106 may be located within duct system 60 immediately adjacent drum outlet 54 (i.e., such that air exiting drum 26 flows over humidity sensor 106). Humidity sensor 106 may be configured to sense a humidity (or relative humidity) of MLA immediately upon exiting chamber 25. Humidity sensor 106 may be operably connected with controller 56. Accordingly, the sensed humidity of the MLA may be transmitted to controller 56.

As used herein, the terms "humidity sensor" or the equivalent may be intended to refer to any suitable type of humidity measuring system or device positioned at any suitable location for measuring the desired humidity. Thus, for example, "humidity sensor" may refer to any suitable type of humidity sensor, such as capacitive digital sensors, resistive sensors, and thermal conductivity humidity sensors. In addition, humidity sensor 106 may be positioned at any suitable location and may output a signal, such as a voltage, to a controller that is proportional to or indicative of the humidity being measured. Although exemplary positioning of humidity sensors is described herein, it should be appreciated that laundry appliance 10 may include any other suitable number, type, or position of humidity sensors according to alternative embodiments.

The process air may include a mass flow rate. In detail, the mass flow rate may be a mass flow rate of moisture (e.g., water vapor) carried by the process air (e.g., the MLA). The mass flow rate may vary throughout an entire drying cycle, such that different levels of moisture are captured from chamber 25 and carried to evaporator 82 (e.g., via blower fan 48). The mass flow rate of air may be based on the temperature of the MLA (e.g., at drum outlet 54), the relative humidity of the MLA (e.g., at drum outlet 54), and a flowrate of the process air through duct system 60. Additionally or alternatively, in determining the mass flow rate of the air, a temperature and humidity of the process air may be measured at drum inlet 52. For instance, an inlet temperature sensor 108 and an inlet humidity sensor 110 may be included and positioned at or near drum inlet 52 (e.g., within duct system 60). For instance, inlet temperature sensor 108 and inlet humidity sensor 110 may be located within duct system 60 immediately adjacent drum inlet 52 (i.e., such that air entering drum 26 flows over inlet temperature sensor 108 and inlet humidity sensor 110). Each of inlet temperature sensor 108 and inlet humidity sensor 110 may be operably connected with controller 56.

The mass flow rate of air may also be based on a flowrate of the process air (e.g., through duct system 60). In detail, the flowrate of the process air may be estimated. For instance, controller 56 may estimate the flowrate of the process air according to an air speed produced by blower fan 48 along with a cross-sectional area of duct system 60. The air speed produced by blower fan 48 may be extrapolated according to a maximum speed or power output available from blower fan 48. As described above, blower fan 48 may be a variable speed fan capable of operating at varying rotational speeds [e.g., in revolutions per minute (RPM)]. Accordingly, the flowrate of the process air may be estimated according to a maximum (or preliminary) rotational speed. Thus, the temperature and relative humidity of the process air at each of the entrance and exit of drum 26 together with the estimated flowrate of the process air may be used to calculate a mass flow rate of moisture through duct system 60.

Figure 4:
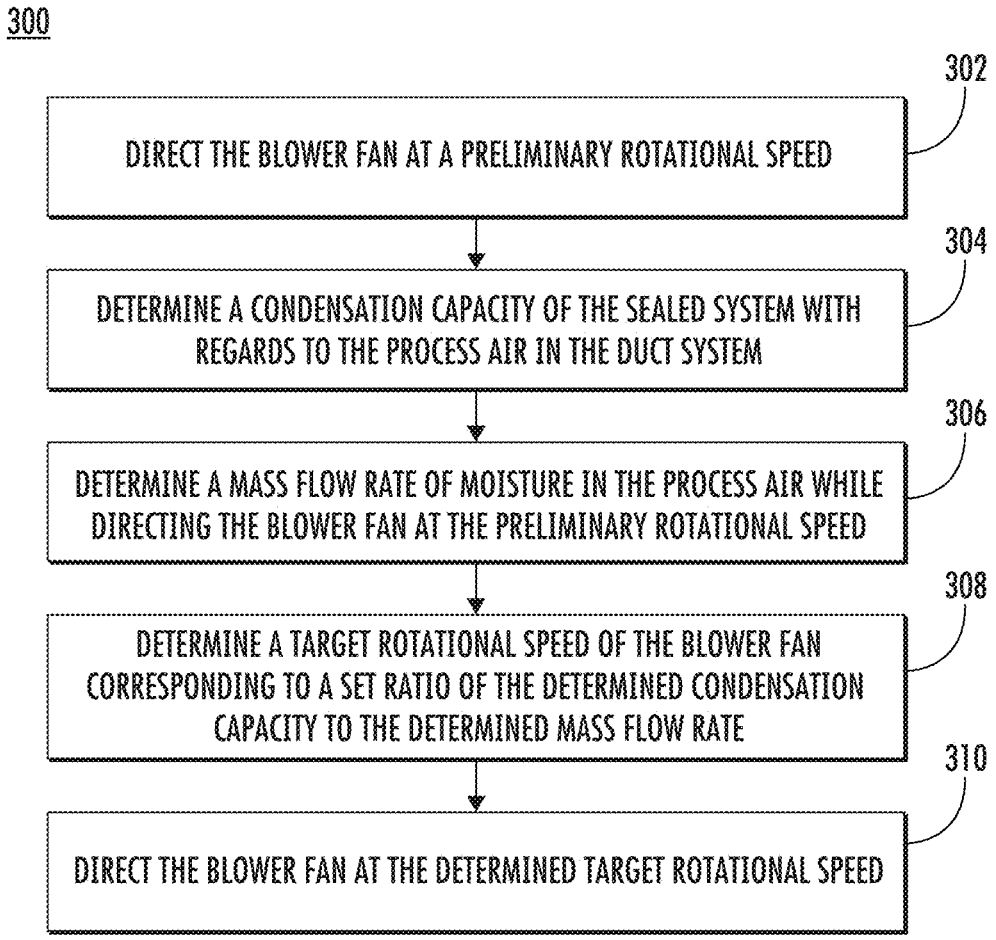
FIG. 4 provides a flow chart of an exemplary method of operating a laundry appliance in a drying cycle according to one or more embodiments of the present disclosure.

FIG. 4 provides a flow diagram of an example method 300 of operating a laundry appliance in a drying cycle. For instance, laundry treatment appliance 10 described herein can be operated as set forth in method 300. FIG. 4 depicts steps performed in a particular order for purposes of illustration and discussion. Those of ordinary skill in the art, using the disclosures provided herein, will understand that various steps of any of the methods disclosed herein can be modified in various ways without deviating from the scope of the present disclosure.

At step 302, method 300 may include directing the blower fan at a preliminary rotational speed. In detail, the laundry treatment appliance may perform a drying operation. During the drying operation, a blower fan (e.g., blower fan 48) may be driven at a preliminary speed to motivate air through a drum and across a sealed refrigerant system to provide heat to the drum and remove moisture from articles provided in the drum. The preliminary speed of the blower fan may be a maximum speed. Accordingly, the blower fan me be directed at a maximum speed at the initiation of the drying operation. In detail, as mentioned above, the blower fan may be a variable speed blower fan, including a maximum speed, a minimum speed, and one or more intermediate speeds (e.g., between maximum and minimum). The maximum speed may be determined according to a power draw of the blower fan, available municipal voltage, machine limitations, or other additional factors. Accordingly, at the maximum speed, the blower fan may be motivating a maximum amount of air through the laundry treatment appliance and thus producing the largest power draw.

The drying operation may include at least three phases. The three phases may include a preheat phase, a steady state drying phase, and a diminished rate drying phase. For instance, the drying operation may begin with the preheat phase. During the preheat phase, a temperature of the sealed refrigerant system may be raised to an operational temperature at which effective drying may occur. The operational temperature may be a predetermined temperature as measured by one or more temperature sensors provided on the sealed refrigerant system (e.g., on a refrigerant line thereof, on an evaporator, on a condenser, etc.). For instance, a temperature of each of a condenser and an evaporator may be altered as a compressor motivates refrigerant therethrough, as described above. Upon reaching the operational temperature (e.g., in response to the same), the drying operation may enter the steady state drying phase. During the steady state drying phase, process air is continually motivated across the evaporator and condenser (e.g., by the blower fan) before being introduced to the drum. During the steady state drying phase, the blower fan may be operated at a plurality of rotational speeds, as will be explained in further detail below. For instance, as mentioned, the blower fan may be initiated at the maximum rotational speed. The steady state drying phase may be performed until a predetermined level of dryness is reached. For instance, during the steady state drying phase, the mass flow rate of moisture in the process air may exceed a condensation capacity of the sealed refrigerant system (e.g., when the blower fan is directed at the preliminary rotational speed). The drying operation may then enter the diminished rate drying phase. During the diminished rate drying phase, the condensation capacity of the sealed refrigerant system may exceed the mass flow rate of moisture in the process air. In detail, as a moisture level of the articles within the drum diminishes, less moisture is circulated through the duct system (e.g., by the blower fan). The condensation capacity of the sealed refrigerant system may remain constant, however. Thus, the sealed refrigerant system is capable of removing more moisture from the process air than is being circulated (e.g., over the evaporator). As will be described below, certain advantageous adjustments may be made to increase efficiency of the drying operation.

At step 304, method 300 may include determining the condensation capacity of the sealed system with regards to the process air in the duct system. The condensation capacity of the sealed system may be determined when the drying operation reaches the steady state drying phase. Determining the condensation capacity may allow the appliance (e.g., via the controller) to determine a maximum rate of moisture that can be removed from the process air. As described above, the condensation capacity of the sealed refrigerant system may be based on a compressor speed, a suction line temperature (e.g., at the compressor), and one or more temperature measurements of the refrigerant being cycled through the sealed system. The condensation capacity of the sealed system may thus determine a maximum drying rate capable of being achieved by the sealed system. In other words, the condensation capacity may dictate the maximum amount of moisture the sealed system is able to remove from the process air.

At step 306, method 300 may include determining a mass flow rate of moisture in the process air (e.g., while directing the blower fan at the preliminary rotational speed). For instance, step 306 may be performed after the drying operation has reached the steady state drying phase. In additional or alternative embodiments, step 306 may be performed upon an initiation of the drying operation (e.g., during the preheat phase or in conjunction with step 302). As described above, the mass flow rate of moisture in the process air may be based on a temperature of the process air at the entrance to the drum, a relative humidity of the air at the entrance to the drum, a temperature of the process air at the exit of the drum, a relative humidity of the air at the exit of the drum, and a flowrate of the process air (e.g., as estimated). The mass flow rate of air may thus depend on a rotational speed of the blower fan (e.g., as function of the flowrate of the process air). For example, as explained below, the mass flow rate of moisture in the process air may be adjusted by adjusting a rotational speed of the blower fan.

At step 308, method 300 may include determining a target rotational speed of the blower fan. In some embodiments, the target rotational speed corresponds to a set or predetermined ratio of the condensation capacity to the mass flow rate (e.g., such as to match or equate the two to each other). In detail, the condensation capacity of the sealed system may be compared to the determined mass flow rate of moisture in the process air. When the condensation capacity is greater than the determined mass flow rate of moisture in the process air, the drying rate may be considered as air side limited. For instance, the sealed system is capable of removing more moisture from the process air than the actual amount of moisture that is being carried by the process air. Conversely, when the mass flow rate of moisture in the process air is greater than the condensation capacity of the sealed system, the drying rate may be considered as sealed system limited. For instance, when the mass flow rate is greater, there is more moisture in the air being delivered to the sealed system than is capable of being removed by the sealed system. Accordingly, a predetermined amount of moisture is then returned to the drum.

Thus, the set ratio of the determined condensation capacity to the determined mass flow rate may seek to balance the two to ensure that the condensation capacity matches the mass flow rate. Accordingly, the set ratio may be 1:1. When the condensation capacity is equal to the mass flow rate of moisture in the process air, the largest amount of moisture in the process air can be removed by the sealed system. In at least some applications, during the steady state drying phase, the mass flow rate of moisture in the process air exceeds the condensation capacity of the sealed system. Accordingly, to generate the set ratio of the determined condensation capacity to the determined mass flow rate, a rotational speed of the blower fan may be adjusted.

At step 310, method 300 may include directing the blower fan at the target rotational speed. As described above, upon determining the target rotational speed (e.g., such that the set ratio of condensation capacity to mass flow rate is 1:1), the blower fan may be driven at the target rotational speed. For example, the rotational speed of the blower fan may be reduced in order to reduce the flowrate of process air, and thus reduce the mass flow rate of moisture in the process air.

As described above, the blower fan may be a variable speed blower. Accordingly, the blower fan may be operable at a plurality of different rotational speeds. The plurality of different speeds may include two or more set, distinct speeds (e.g., stepped according to RPM in steps of 10 RPM, 100 RPM, or the like). According to some embodiments, the blower fan may be infinitely variable. For instance, the blower fan may be adjustable to any rotational speed between zero and the maximum speed.

According to some embodiments, method 300 may determine the mass flow rate of moisture in the process air at a plurality of distinct times (e.g., throughout the steady state drying phase). As the mass flow rate increases (e.g., toward a beginning of the steady state drying phase), the rotational speed of the blower fan may be stepped down (e.g., to a lower speed). The gradual change of the blower fan may happen at distinct intervals of the steady state drying phase. Similarly, as the mass flow rate decreases (e.g., toward an end of the steady state drying phase), the rotational speed of the blower fan may be stepped up (e.g., to a higher speed). Thus, throughout the steady state drying phase, the set ratio of condensation capacity of the sealed system against the mass flow rate of moisture in the process air may be maintained.

In some instances, the target rotational speed is a low rotational speed setting. The low rotational speed setting may be a predetermined percentage of the preliminary rotational speed or maximum rotational speed. Advantageously, a power draw of the blower fan (and thus of the laundry treatment apparatus) may be reduced during the steady state drying phase. By matching the mass flow rate of moisture to the condensation capacity of the sealed system, an efficiency of the laundry treatment appliance is maximized.

In additional or alternative embodiments, the controller may determine that the drying operation is in the diminished rate drying phase. For instance, the controller may determine that the mass flow rate of moisture in the process air is less than the condensation capacity of the sealed system (e.g., after performing step 310). Accordingly, the blower fan may be driven at the preliminary rotational speed (or maximum rotational speed). Additionally or alternatively, an operational speed of the compressor (e.g., of the sealed system) may be reduced. In detail, upon determining that the sealed system is running at maximum capacity such that the condensation capacity is at a maximum, the operational speed of the compressor may be reduced so as to reduce the effective condensation capacity of the sealed system. Accordingly, the set ratio between the condensation capacity and the mass flow rate may be maintained in the diminished rate drying phase of the drying operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance, comprising:

a cabinet;

a drum rotatably mounted within the cabinet, the drum defining a chamber for receipt of articles, the drum defining a drum outlet and a drum inlet to the chamber;

a sealed system configured to heat and remove moisture from process air flowing therethrough, the sealed system comprising a compressor operable to urge a refrigerant through a refrigerant line;

a duct system for providing fluid communication between the drum outlet and the sealed system and between the sealed system and the drum inlet, the duct system, the sealed system, and the drum defining a process air flow path;

a blower fan operable to move process air along the process air flow path, the blower fan capable of operating at variable rotational speeds;

a temperature sensor provided within the duct system at the drum outlet to sense a temperature of the process air at the drum outlet;

a humidity sensor provided within the duct system at the drum outlet to sense a relative humidity of the process air at the drum outlet; and a controller configured to perform an operation, the operation comprising:

directing the blower fan at a preliminary rotational speed;

determining a condensation capacity of the sealed system with regards to the process air in the duct system;

estimating an air flowrate of the process air at the drum outlet;

determining a mass flow rate of moisture in the process air while directing the blower fan at the preliminary rotational speed, wherein the determined mass flow rate of the moisture in the process air is based on the estimated air flowrate, a sensed relative humidity, and a sensed temperature of the process air at the drum outlet;

determining a target rotational speed of the blower fan corresponding to a set ratio of the determined condensation capacity to the determined mass flow rate; and directing the blower fan at the determined target rotational speed.

2. The laundry treatment appliance of claim 1, wherein the set ratio of the determined condensation capacity to the determined mass flow rate is 1:1 such that the condensation capacity of the sealed system is equal to the mass flow rate of moisture in the process air.

3. The laundry treatment appliance of claim 1, wherein the air flowrate of the process air is estimated according to a cross-sectional area of the process air flow path and an air speed produced by the blower fan.

4. The laundry treatment appliance of claim 1, wherein the sealed system further comprises:

a first refrigerant temperature sensor provided on the refrigerant line at a first location; and a second refrigerant temperature sensor provided on the refrigerant line at a second location spaced apart from the first location.

5. The laundry treatment appliance of claim 4, wherein the condensation capacity of the sealed system is determined according to a temperature difference between the first and second refrigerant temperature sensors and an operational speed of the compressor.

6. The laundry treatment appliance of claim 5, wherein directing the blower fan at the target rotational speed comprises:

reducing the rotational speed of the blower fan from the preliminary rotational speed to a low speed to reduce the mass flow rate of moisture in the process air.

7. The laundry treatment appliance of claim 1, wherein the operation further comprises:

a preheat phase;

a steady state drying phase following the preheat phase, wherein the mass flow rate of moisture in the process air exceeds the condensation capacity of the sealed system when the blower fan is directed at the preliminary rotational speed; and a diminished rate drying phase following the steady state drying phase, wherein the condensation capacity of the sealed system exceeds the mass flow rate of moisture in the process air when the blower fan is directed at the preliminary rotational speed.

8. The laundry treatment appliance of claim 7, wherein the blower fan is directed at the determined rotational speed during the steady state drying phase.

9. The laundry treatment appliance of claim 7, wherein the operation further comprises:

determining that the drying operation is performing the diminished rate drying phase such that the condensation capacity of the sealed system exceeds the mass flow rate; and reducing an operational speed of the compressor during the diminished rate drying phase upon determining that the condensation capacity of the sealed system exceeds the mass flow rate.

10. A method of operating a laundry treatment appliance, the laundry treatment appliance comprising a drum, a duct system in fluid communication with the drum through which process air flows, a sealed system comprising a compressor configured to heat and remove moisture from the process air, the sealed system comprising a compressor operable to urge a refrigerant through a refrigerant line, a blower fan provided within the duct system, a temperature sensor provided within the duct system at a drum outlet to sense a temperature of the process air at the drum outlet, and a humidity sensor provided within the duct system at the drum outlet to sense a relative humidity of the process air at the drum outlet, the method comprising:

directing the blower fan at a preliminary rotational speed;

determining a condensation capacity of the sealed system with regards to the process air in the duct system;

estimating an air flowrate of the process air at the drum outlet;

determining a mass flow rate of moisture in the process air while directing the fan at the preliminary rotational speed, wherein the determined mass flow rate of the moisture in the process air is based on the estimated air flowrate, a sensed relative humidity, and a sensed temperature of the process air at the drum outlet;

determining a target rotational speed of the blower fan corresponding to a set ratio of the determined condensation capacity to the determined mass flow rate; and directing the blower fan at the determined target rotational speed.

11. The method of claim 10, wherein the set ratio is 1:1 such that the condensation capacity of the sealed system is equal to the mass flow rate of moisture in the process air.

12. The method of claim 10, wherein the air flowrate of the process air is estimated according to a cross-sectional area of the duct system and an air speed produced by the blower fan.

13. The method of claim 10, wherein the sealed system further comprises:

a first refrigerant temperature sensor provided on the refrigerant line at a first location; and a second refrigerant temperature sensor provided on the refrigerant line at a second location spaced apart from the first location.

14. The method of claim 13, wherein the condensation capacity of the sealed system is determined according to a temperature difference between the first and second refrigerant temperature sensors and an operational speed of the compressor.

15. The method of claim 14, wherein directing the blower fan at the determined target rotational speed comprises:

reducing the rotational speed of the blower fan from the preliminary speed to a low speed to reduce the mass flow rate of moisture in the process air.

16. The method of claim 10, wherein the drying operation comprises:

a preheat phase;

a steady state drying phase following the preheat phase; and a diminished rate drying phase following the steady state drying phase, wherein the blower fan is directed at the determined target rotational speed during the steady state drying phase.

* * * * *